US012054993B2

(12) United States Patent
Patterson

(10) Patent No.: US 12,054,993 B2
(45) Date of Patent: Aug. 6, 2024

(54) SIDE SADDLE RIG DESIGN WITH RETRACTABLE TOP DRIVE

(71) Applicant: NABORS DRILLING TECHNOLOGIES USA, INC., Houston, TX (US)

(72) Inventor: Derek Patterson, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 17/694,140

(22) Filed: Mar. 14, 2022

(65) Prior Publication Data

US 2022/0298869 A1 Sep. 22, 2022

Related U.S. Application Data

(60) Provisional application No. 63/161,759, filed on Mar. 16, 2021.

(51) Int. Cl.
*E21B 15/00* (2006.01)
*E21B 19/15* (2006.01)

(52) U.S. Cl.
CPC ..... *E21B 15/003* (2013.01); *E21B 19/155* (2013.01)

(58) Field of Classification Search
CPC ..... E21B 15/003; E21B 19/087; E21B 19/15
See application file for complete search history.

(56) References Cited

U.S. PATENT DOCUMENTS

| | | | |
|---|---|---|---|
| 1,733,484 | A | 10/1929 | Davis |
| 2,332,479 | A | 10/1943 | Woolslayer et al. |
| 2,345,253 | A | 3/1944 | Funk |
| 2,347,115 | A | 4/1944 | Lewis |
| 2,594,847 | A | 4/1952 | Bates et al. |
| 2,792,198 | A | 5/1957 | Braun |
| 3,028,881 | A | 4/1962 | Koomey et al. |
| 3,228,151 | A | 1/1966 | Woolslayer et al. |
| 3,255,836 | A | 6/1966 | Hoppmann et al. |
| 3,433,268 | A | 3/1969 | Greer |
| 3,483,933 | A | 12/1969 | Dyer et al. |
| 3,576,225 | A | 4/1971 | Chambers |

(Continued)

FOREIGN PATENT DOCUMENTS

| | | | |
|---|---|---|---|
| CA | 2755483 | A1 | 11/2010 |
| CA | 2753417 | A1 | 2/2011 |

(Continued)

OTHER PUBLICATIONS

Nabors 990 Proyecto llanos.wmv; https://www.youtube.com/watch?v=6BgfgWumRIU, Nabors Rig 990 Chichimene, Colombia; Youtube.com; Aug. 10, 2011 (231 pages).

(Continued)

*Primary Examiner* — Nicole Coy
*Assistant Examiner* — Nicholas D Wlodarski
(74) *Attorney, Agent, or Firm* — Ewing & Jones, PLLC

(57) ABSTRACT

A drilling rig may include a mast and a top drive system. The mast is aligned with a wellbore, the wellbore defining a wellbore centerline. The top drive system may include a top drive. The top drive is movable vertically relative to the mast. The top drive is movable horizontally between a position aligned with the wellbore centerline and a position out of alignment with the wellbore centerline.

10 Claims, 10 Drawing Sheets

(56) References Cited

U.S. PATENT DOCUMENTS 3,598,189 A 8/1971 Presley
3,676,984 A 7/1972 Clark
3,716,149 A 2/1973 Scaggs
3,739,853 A 6/1973 Wales
3,754,361 A 8/1973 Branham et al.
3,802,137 A 4/1974 Armstrong
3,851,770 A 12/1974 Jenkins et al.
3,921,739 A 11/1975 Rich et al.
3,922,825 A 12/1975 Eddy et al.
3,937,334 A 2/1976 Bleyl et al.
3,942,593 A 3/1976 Reeve, Jr. et al.
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,375,892 A 3/1983 Jenkins et al.
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A 7/1988 Willis
4,821,816 A 4/1989 Willis
4,823,870 A 4/1989 Sorokan
4,834,604 A 5/1989 Brittain et al.
4,837,992 A 6/1989 Hashimoto
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A 7/1999 Reed
6,161,358 A 12/2000 Mochizuki et al.
6,343,892 B1 2/2002 Kristiansen
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,249,629 B2 7/2007 Cunningham et al.
7,255,180 B2 8/2007 Beato et al.
7,306,055 B2 12/2007 Barnes
7,308,953 B2 12/2007 Barnes
7,357,616 B2 4/2008 Andrews et al.
7,401,656 B2 7/2008 Wood et al.
7,404,697 B2 7/2008 Thompson
7,584,809 B1 9/2009 Flud
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,490,724 B2 7/2013 Smith et al.
8,516,751 B2 8/2013 Konduc et al.
8,549,815 B2 10/2013 Donnally et al.
8,555,564 B2 10/2013 Wasterval
8,561,685 B2 10/2013 Rodgers
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 12/2014 Donnally et al.
8,936,424 B1 1/2015 Barnes
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,091,128 B1 7/2015 Orgeron et al.
9,096,282 B2 8/2015 Smith et al.
9,132,871 B2 9/2015 Crisp et al.
9,140,080 B2 9/2015 Flusche
9,151,412 B2 10/2015 Trevithick et al.
9,157,286 B2 10/2015 Richardson et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,518,429 B2 12/2016 Fortson et al.
9,533,723 B2 1/2017 Smith et al.
9,562,407 B2 2/2017 Magnuson
9,574,402 B2 2/2017 Hause
9,580,122 B2 2/2017 Doherty
9,624,734 B2 4/2017 Davis et al.
9,631,443 B2 4/2017 Folk
9,650,840 B2 5/2017 Cheng et al.
9,677,298 B2 6/2017 Konduc et al.
9,708,861 B2 7/2017 Reddy et al.
9,739,098 B2 8/2017 Fox
9,784,040 B2 10/2017 Smith et al.
9,790,751 B2 10/2017 Reddy et al.
9,797,196 B2 10/2017 Taggart et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
9,951,539 B2 4/2018 Roodenburg et al.
10,094,137 B2 10/2018 Reddy et al.
10,094,176 B2 10/2018 Reddy et al.
10,094,186 B2 10/2018 Dillard et al.
10,144,463 B2 12/2018 Flusche et al.
10,214,936 B2 2/2019 Reddy et al.
10,214,937 B2 2/2019 Reddy et al.
10,214,970 B1 2/2019 Gupta et al.
10,221,631 B2 3/2019 Reddy et al.
10,273,708 B2 4/2019 Holst et al.
10,280,692 B2 5/2019 Reddy et al.
10,358,877 B1 7/2019 Gupta et al.
10,407,938 B2 9/2019 Reddy et al.
10,487,592 B1 11/2019 Gupta et al.

(56) References Cited

U.S. PATENT DOCUMENTS

| | | | |
|---|---|---|---|
| 10,557,281 | B2 | 2/2020 | Reddy et al. |
| 10,648,240 | B2 | 5/2020 | Reddy et al. |
| 10,704,337 | B2 | 7/2020 | Gupta et al. |
| 10,731,375 | B2 | 8/2020 | Reddy et al. |
| 10,837,238 | B2 | 11/2020 | Gupta et al. |
| 10,865,583 | B2 | 12/2020 | Reddy et al. |
| 11,053,745 | B2 | 7/2021 | Reddy et al. |
| 11,111,734 | B2 | 9/2021 | Gupta et al. |
| 11,230,855 | B2 | 1/2022 | Reddy et al. |
| 11,242,695 | B2 | 2/2022 | Reddy et al. |
| 11,371,291 | B2 | 6/2022 | Gupta et al. |
| 2002/0001255 | A1 | 1/2002 | Flood et al. |
| 2003/0172599 | A1 | 9/2003 | Frink |
| 2004/0211598 | A1 | 10/2004 | Palidis |
| 2008/0237170 | A1 | 10/2008 | Altman et al. |
| 2009/0000218 | A1 | 1/2009 | Lee et al. |
| 2009/0025980 | A1 | 1/2009 | Callander et al. |
| 2009/0053013 | A1 | 2/2009 | Maltby |
| 2009/0272540 | A1 | 11/2009 | Rodgers |
| 2009/0321135 | A1 | 12/2009 | Vora |
| 2010/0032213 | A1 | 2/2010 | Orgeron |
| 2010/0038088 | A1 | 2/2010 | Springett et al. |
| 2010/0186960 | A1 | 7/2010 | Reitsma et al. |
| 2010/0329823 | A1 | 12/2010 | Baumier et al. |
| 2011/0072737 | A1 | 3/2011 | Wasterval |
| 2011/0174545 | A1 | 7/2011 | Hartke et al. |
| 2011/0247290 | A1 | 10/2011 | Beck et al. |
| 2011/0280104 | A1 | 11/2011 | McClung, II |
| 2012/0168179 | A1 | 7/2012 | Having et al. |
| 2012/0304553 | A1 | 12/2012 | Konduc et al. |
| 2013/0153309 | A1 | 6/2013 | Smith et al. |
| 2013/0180185 | A1 | 7/2013 | Ferrari |
| 2013/0305632 | A1 | 11/2013 | Rivera, Sr. et al. |
| 2013/0327543 | A1 | 12/2013 | Reddy et al. |
| 2013/0330151 | A1 | 12/2013 | Orgeron |
| 2014/0014417 | A1 | 1/2014 | Smith et al. |
| 2014/0044510 | A1 | 2/2014 | Eldib et al. |
| 2014/0054097 | A1 | 2/2014 | Bryant |
| 2014/0224541 | A1 | 8/2014 | Hause |
| 2014/0224543 | A1 | 8/2014 | Padira et al. |
| 2015/0008039 | A1 | 1/2015 | Wijning et al. |
| 2015/0034327 | A1 | 2/2015 | Ahn et al. |
| 2015/0090450 | A1 | 4/2015 | Thiessen |
| 2015/0135607 | A1 | 5/2015 | Ferrari |
| 2015/0300104 | A1 | 10/2015 | Orgeron et al. |
| 2015/0315861 | A1 | 11/2015 | Zachariasen et al. |
| 2016/0002946 | A1 | 1/2016 | Wijning et al. |
| 2016/0010323 | A1 | 1/2016 | Konduc et al. |
| 2016/0130877 | A1 | 5/2016 | Fortson |
| 2016/0186495 | A1 | 6/2016 | Flusche |
| 2016/0215592 | A1 | 7/2016 | Helms et al. |
| 2016/0251870 | A1 | 9/2016 | Thiessen et al. |
| 2016/0258215 | A1 | 9/2016 | Holst |
| 2016/0258225 | A1 | 9/2016 | Holst |
| 2016/0280524 | A1 | 9/2016 | Crisp et al. |
| 2016/0369570 | A1 | 12/2016 | Reddy et al. |
| 2017/0081924 | A1 | 3/2017 | Smith et al. |
| 2017/0096832 | A1 | 4/2017 | Robb |
| 2017/0106925 | A1 | 4/2017 | Gupta et al. |
| 2017/0107735 | A1 | 4/2017 | Wasterval |
| 2017/0241126 | A1 | 8/2017 | Konduc et al. |
| 2017/0292334 | A1 | 10/2017 | Reddy et al. |
| 2017/0328081 | A1 | 11/2017 | Trevithick |
| 2017/0350153 | A1 | 12/2017 | Reddy et al. |
| 2018/0016851 | A1 | 1/2018 | Reddy et al. |
| 2018/0030788 | A1 | 2/2018 | Reddy et al. |
| 2018/0086399 | A1 | 3/2018 | Smith et al. |
| 2018/0119496 | A1 | 5/2018 | Reddy et al. |
| 2018/0128056 | A1 | 5/2018 | Gupta et al. |
| 2018/0328112 | A1* | 11/2018 | Berry ..... E21B 19/155 |
| 2019/0106945 | A1 | 4/2019 | Basile et al. |
| 2019/0338600 | A1 | 11/2019 | Gupta et al. |
| 2019/0360311 | A1 | 11/2019 | Camacho Cardenas et al. |
| 2020/0190939 | A1 | 6/2020 | Gray et al. |
| 2022/0065048 | A1 | 3/2022 | Reddy et al. |
| 2022/0298874 | A1 | 9/2022 | Patterson |
| 2024/0102345 | A1 | 3/2024 | Reddy et al. |

FOREIGN PATENT DOCUMENTS

| | | | |
|---|---|---|---|
| CA | 3025968 | A | 12/2017 |
| CA | 3039669 | A | 5/2018 |
| CA | 3004427 | C | 3/2020 |
| CA | 3009407 | C | 7/2020 |
| CA | 3027526 | C | 5/2022 |
| CA | 3025968 | C | 8/2022 |
| CA | 3039669 | C | 8/2022 |
| CA | 3050044 | C | 5/2023 |
| CN | 2746112 | Y | 12/2005 |
| CN | 101688437 | A | 3/2010 |
| CN | 201778661 | U | 3/2011 |
| CN | 103397849 | A | 11/2013 |
| CN | 103597163 | A | 2/2014 |
| CN | 104204396 | A | 12/2014 |
| CN | 104541016 | A | 4/2015 |
| CN | 104727745 | A | 6/2015 |
| CN | 106164406 | A | 11/2016 |
| CN | 205977097 | U | 2/2017 |
| CN | 109415895 | A | 3/2019 |
| CN | 110735598 | A | 1/2020 |
| CN | 109312601 | B | 5/2021 |
| CN | 115885084 | A | 3/2023 |
| CO | 9211866800 | A | 11/1969 |
| CO | 38077 | A1 | 12/2020 |
| CO | 16007 | A1 | 3/2021 |
| CO | 74341 | A1 | 11/2021 |
| DE | 849533 | C | 9/1952 |
| EA | 29885 | B1 | 5/2018 |
| EP | 2751370 | B1 | 7/2014 |
| FR | 2556042 | A1 | 6/1985 |
| NO | 344714 | B1 | 3/2020 |
| NO | 347042 | B1 | 4/2023 |
| NO | 847245 | B1 | 7/2023 |
| RU | 2018622 | C1 | 8/1994 |
| RU | 1372 | U1 | 3/2008 |
| RU | 2558098 | C1 | 7/2015 |
| RU | 2732755 | C2 | 9/2020 |
| RU | 2745807 | C2 | 4/2021 |
| RU | 2753741 | C2 | 8/2021 |
| RU | 2794033 | C1 | 4/2023 |
| SA | 8211 | B1 | 6/2021 |
| SA | 9137 | B1 | 12/2021 |
| SA | 9732 | B1 | 4/2022 |
| SA | 9835 | B1 | 4/2022 |
| SA | 9928 | B1 | 5/2022 |
| SA | 11168 | B1 | 10/2022 |
| SA | 12869 | B1 | 5/2023 |
| WO | 9943920 | A1 | 9/1999 |
| WO | 2007143842 | A1 | 12/2007 |
| WO | 2016025521 | A2 | 2/2016 |
| WO | 2016048458 | A1 | 3/2016 |
| WO | 20170214148 | A1 | 12/2017 |
| WO | 2018013258 | A1 | 1/2018 |
| WO | 20180085850 | A1 | 5/2018 |
| WO | 2020060415 | A1 | 3/2020 |
| WO | 20220051192 | A1 | 3/2022 |

OTHER PUBLICATIONS

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

(56) References Cited

OTHER PUBLICATIONS

Office Action issued in Russian App. No. 2019113457 and English translation thereof, dated Feb. 5, 2021 (10 pages).
Office Action issued in Colombian App. No. NC20190007779 and English translation thereof, dated Apr. 29, 2021 (35 pages).
Office Action issued in Saudi Arabian App. No. 119400853 and English translation thereof, dated Jun. 15, 2021 (9 pages).
Office Action issued in Chinese App. No 201780041709.8, dated Jul. 28, 2021 and English translation thereof (22 pages).
Office Action issued in Chinese App. No 201810674046, dated Dec. 17, 2020 and English translation thereof (24 pages).
Office Action issued in U.S. Appl. No. 16/884,239, dated Apr. 1, 2021 (7 pages).
Office Action issued in Chinese App. No 201710623120.0, dated Nov. 2, 2020 and English translation thereof (18 pages).
International Search Report and Written Opinion issued in PCT App. No. PCT/US21/048087, dated Dec. 21, 2021 (10 pages).
Office Action issued in Chinese App. No 201810674046, dated Oct. 9, 2021 and English translation thereof (17 pages).
Office Action issued in Saudi Arabian Application No. 121420956, dated Sep. 25, 2022, with English translation thereof (12 pages).
Office Action issued in Norwegian U.S. Appl. No. 20/190,906, dated Dec. 1, 2022 (5 pages).
Office Action issued in Chinese Application No. 201910658951.0, dated Dec. 30, 2022, and English translation thereof (23 pages).
Office Action issued in Russian Application No. 2019122467, dated Dec. 9, 2022, and English translation thereof (12 pages).

* cited by examiner

SIDE SADDLE RIG DESIGN WITH RETRACTABLE TOP DRIVE

CROSS-REFERENCE TO RELATED APPLICATIONS

This application is a nonprovisional application which claims priority from U.S. provisional application No. 63/161,759, filed Mar. 16, 2021, which is incorporated by reference herein in its entirety.

TECHNICAL FIELD/FIELD OF THE DISCLOSURE

The present disclosure relates to the drilling of wells, and specifically to a drilling rig system for use in a wellsite.

BACKGROUND OF THE DISCLOSURE

When drilling a wellbore, a drilling rig is positioned at the site of the wellbore to be formed, defining a wellsite. A drilling rig may be used to drill the wellbore. Additional wellsite equipment may be utilized with the drilling rig. The wellbore may be drilled using a drill string, made up of a number of tubular members joined end to end and inserted into the wellbore.

SUMMARY

The present disclosure provides for a method. The method may include positioning a drilling rig above a wellbore, the wellbore defining a wellbore centerline. The drilling rig may include a mast, the mast aligned with the wellbore centerline. The drilling rig may include a top drive system, the top drive system including a top drive. The top drive may be movable vertically relative to the mast. The top drive may be movable horizontally between a position aligned with the wellbore centerline and a position out of alignment with the wellbore centerline. The method may include coupling a drill string to the top drive, lowering the drill string into the wellbore by lowering the top drive system, decoupling the drill string from the top drive, retracting the top drive from the wellbore centerline, positioning a new tubular member into the space above the drill string aligned with the wellbore centerline, coupling the new tubular member to the drill string, moving the top drive to a raised position while the new tubular member is aligned with the wellbore centerline, extending the top drive into alignment with the wellbore centerline, and coupling the new tubular member to the top drive.

The present disclosure also provides for a method. The method may include positioning a drilling rig above a wellbore, the wellbore defining a wellbore centerline. The drilling rig may include a mast, the mast aligned with the wellbore centerline. The drilling rig may include a top drive system. The top drive system may include a top drive. The top drive may be movable vertically relative to the mast. The top drive may be movable horizontally between a position aligned with the wellbore centerline and a position out of alignment with the wellbore centerline. The method may include coupling a drill string to the top drive, raising the drill string by raising the top drive system, decoupling the drill string from the top drive, retracting the top drive from the wellbore centerline, decoupling a tubular member from the upper end of the drill string, removing the tubular member from the space above the drill string aligned with the wellbore centerline, moving the top drive to a lowered position while the tubular member is decoupled from the drill string and is aligned with the wellbore centerline, extending the top drive into alignment with the wellbore centerline, and coupling the drill string to the top drive.

The present disclosure also provides for a drilling rig. The drilling rig may include a mast, the mast aligned with a wellbore, the wellbore defining a wellbore centerline. The drilling rig may include a top drive system. The top drive system may include a top drive. The top drive may be movable vertically relative to the mast. The top drive may be movable horizontally between a position aligned with the wellbore centerline and a position out of alignment with the wellbore centerline.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
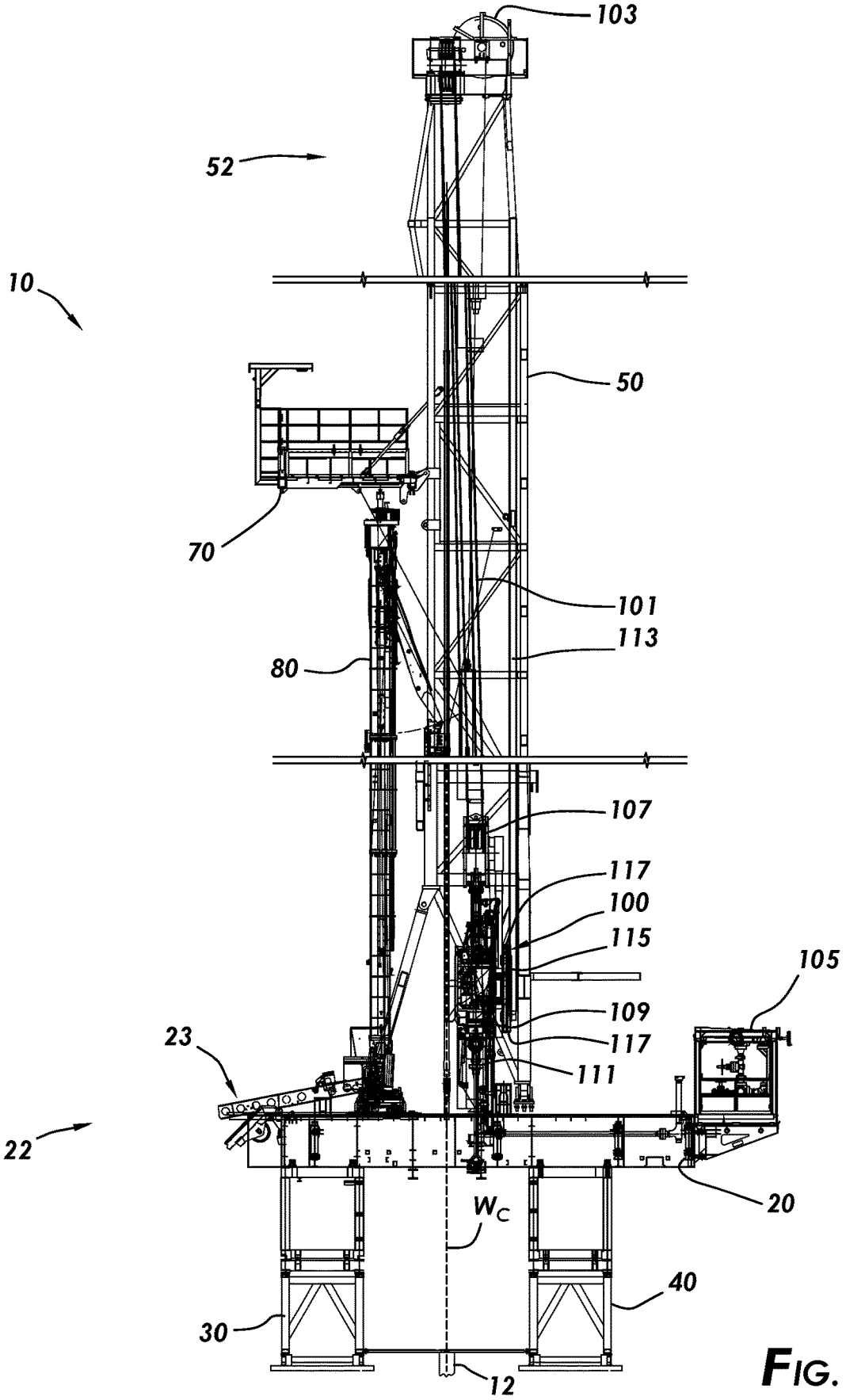
FIG. 1 depicts a side view of a drilling rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a side elevation of drilling rig 10 consistent with at least one embodiment of the present disclosure. Drilling rig 10 may include drill rig floor 20, left substructure 30, and right substructure 40. Left and right substructures 30, 40 may support drill rig floor 20. Mast 50 may be mechanically coupled to one or both of left and right substructures 30, 40 or drill rig floor 20. As would be understood by one having ordinary skill in the art with the benefit of this disclosure, the terms "left" and "right" as used herein are used only to refer to each separate substructure to simplify discussion and are not intended to limit this disclosure in any way. In some embodiments, drill rig floor 20 may include V-door 23, defining a V-door side of drill rig floor 20 and V-door side 22 of drilling rig 10. In some embodiments, drilling rig 10 may be a side-saddle drilling rig such that V-door 23 and V-door side 22 may be located over left substructure 30. V-door side 52 of mast 50 may correspondingly face left substructure 30. By facing V-door side 22 of drilling rig 10 toward one of the substructures 30, 40, equipment and structures that pass through the V-door 23 or to drill rig floor 20 from V-door side 22 of drilling rig 10 may, for example, be less likely to interfere with additional wells in the well field, pad, or location. In other embodiments, V-door side 22 and mast V-door side 52 may face right substructure 40. In some embodiments, as depicted in FIG. 1, drilling rig 10 and mast 50 may be centered over wellbore 12. Wellbore 12 may define wellbore centerline $w_c$.

In some embodiments, drilling rig 10 may include provisions for storage of pipe tubulars to be used during a drilling operation including, for example and without limitation, racking board 70. Racking board 70, as understood in the art, may allow tubulars or tubular stands to be racked on drill rig floor 20 and accessed during operation of drilling rig 10. In some embodiments, drilling rig 10 may include pipe handling apparatus 80. Pipe handling apparatus 80 may be used to transfer tubulars between wellbore centerline we and racking board 70 or other storage locations during operations of drilling rig 10. For example, pipe handling apparatus 80 may provide tubular members to wellbore centerline we during a tripping in operation as further discussed below.

In some embodiments, drilling rig 10 may include a rotary system, referred to herein as top drive system 100. Top drive system 100 may, in some embodiments, include a hook and swivel and top drive 109 as discussed below. Top drive system 100 may be positioned within mast 50 and may be movable upward and downward. In some embodiments, top drive system 100 may be movable vertically using one or more cables 101 coupled between top drive system 100 and crown block 103, with cables 101 moved by drawworks 105. In some embodiments, top drive system 100 may be coupled to cables 101 by traveling block 107. In other embodiments, top drive system 100 may be moved vertically using any other hoisting system including, for example and without limitation, a rack and pinion drive system.

In some embodiments, top drive system 100 may include top drive 109. Top drive 109 may include quill 111. Quill 111 may be adapted to couple to a tubular member of a drill string used to drill wellbore 12. Top drive 109 may provide rotation to the drill string, provide for vertical movement of the drill string or casing string using drawworks 105 or other hoisting system, and provide drill fluid delivery to the drill string and to the wellbore annulus therethrough.

Figure 2:
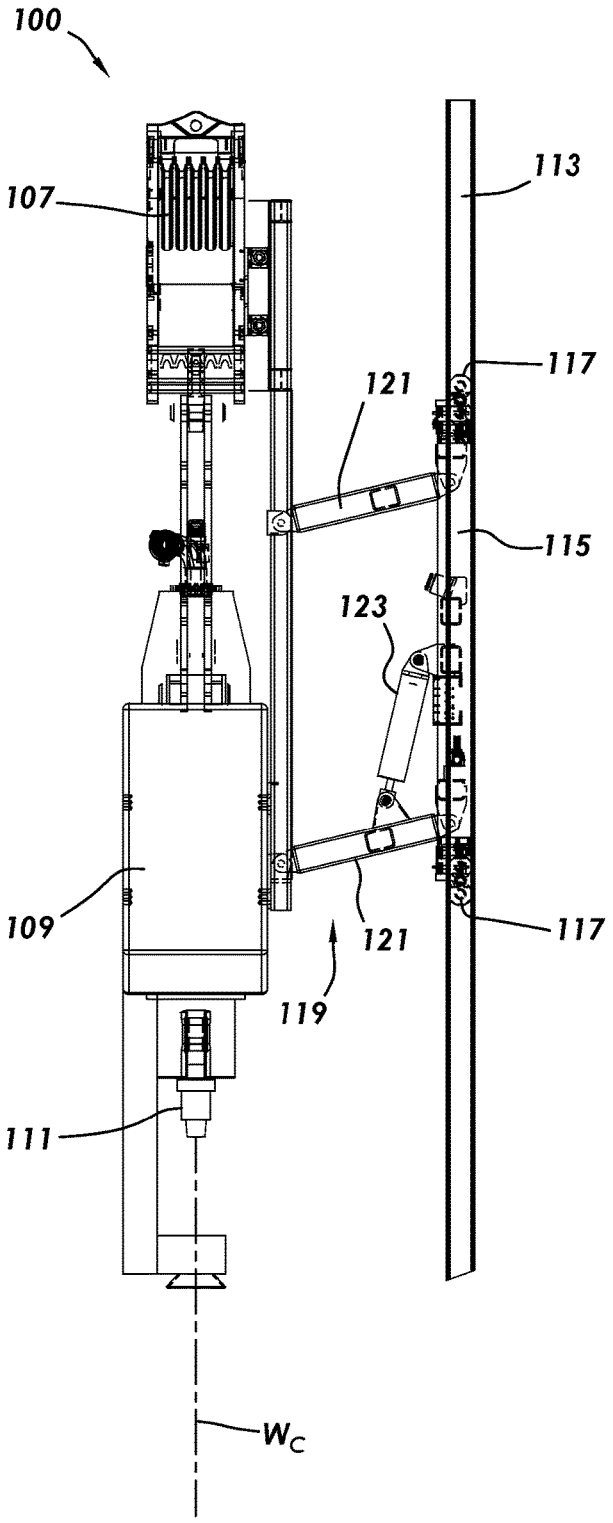
FIG. 2 depicts a side view of a top drive system of a drilling rig consistent with at least one embodiment of the present disclosure.
Figure 2A:
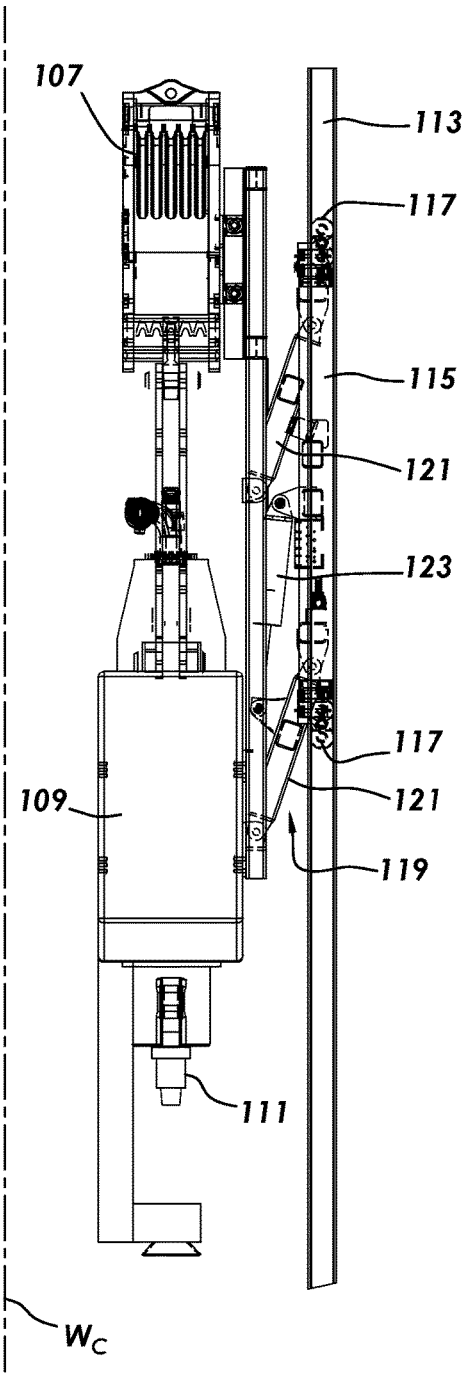
FIG. 2A depicts a side view of the top drive system of FIG. 2 in a retracted position.

In some embodiments, mast 50 may include guide rails 113. Top drive system 100 may be mechanically coupled to guide rails 113 such that top drive system 100 is guided in the vertical direction by guide rails 113. In some embodiments, top drive system 100 may mechanically couple to guide rails 113 through trolley 115 as shown in FIGS. 2, 2A. In some embodiments, trolley 115 may be mechanically coupled to guide rails 113 by, for example and without limitation, one or more rollers 117. In some embodiments, one or more bushings or bearings may be used including, for example and without limitation, a ultra-high molecular weight (UHMW) polyethylene, polyurethane, polytetrafluoroethylene, or other material bushing or bearing.

In some embodiments, top drive system 100 may be adapted to be movable in a horizontal or substantially horizontal direction. In some such embodiments, top drive system 100 may be movable from a position in which top drive 109 is aligned with wellbore centerline $w_c$, referred to herein as an extended position, to a position in which top drive 109 is out of alignment with wellbore centerline $w_c$, referred to herein as a retracted position. When top drive system 100 is in the retracted position, because top drive 109 and other equipment of top drive system 100 are out of alignment with wellbore centerline $w_c$, wellbore centerline $w_c$ and thus the vertical space above the drill string or casing string may be accessible regardless of the vertical position of top drive system 100 as further discussed below.

FIG. 2 depicts an example of embodiments of top drive system 100 in the extended position, and FIG. 2A depicts an example of embodiments of top drive system 100 in the retracted position. In some embodiments, when in the retracted position, all elements of top drive system 100 may be out of alignment with wellbore centerline $w_c$. In some such embodiments, traveling block 107 may be repositioned out of alignment with wellbore centerline $w_c$ along with top drive 109.

In some embodiments, top drive system 100 may include top drive extension mechanism 119. Top drive extension mechanism 119 may, in certain embodiments, extend between trolley 115 and top drive 109. Top drive extension mechanism 119 may include one or more systems configured to selectively move top drive 109 between the extended and retracted positions. For example, and without limitation, as shown in FIGS. 2, 2A, top drive extension mechanism 119 may include one or more linkages 121 coupled between top drive 109 and trolley 115 and an actuator 123 positioned to cause linkages 121 to pivot relative to trolley 115 and top drive 109 such that the distance between trolley 115 and top drive 109 is increased. In some embodiments, actuator 123 may be, for example and without limitation, hydraulically, pneumatically, electromechanically driven using a hydraulic cylinder, rack and pinion system, screw, geared, or other mechanism for extending and retracting top drive system 100. As trolley 115 is held in place horizontally by guide rails 113, top drive 109 is moved horizontally or substantially horizontally relative to mast 50 by the operation of top drive extension mechanism 119.

In some embodiments, traveling block 107 may be moved out of alignment with wellbore centerline we by virtue of the mechanical coupling to top drive 109. In other embodiments, traveling block 107 may be mechanically coupled to top drive extension mechanism 119 such that operation of top drive extension mechanism 119 actively repositions traveling block 107 as shown in FIGS. 2, 2A.

Figure 3:
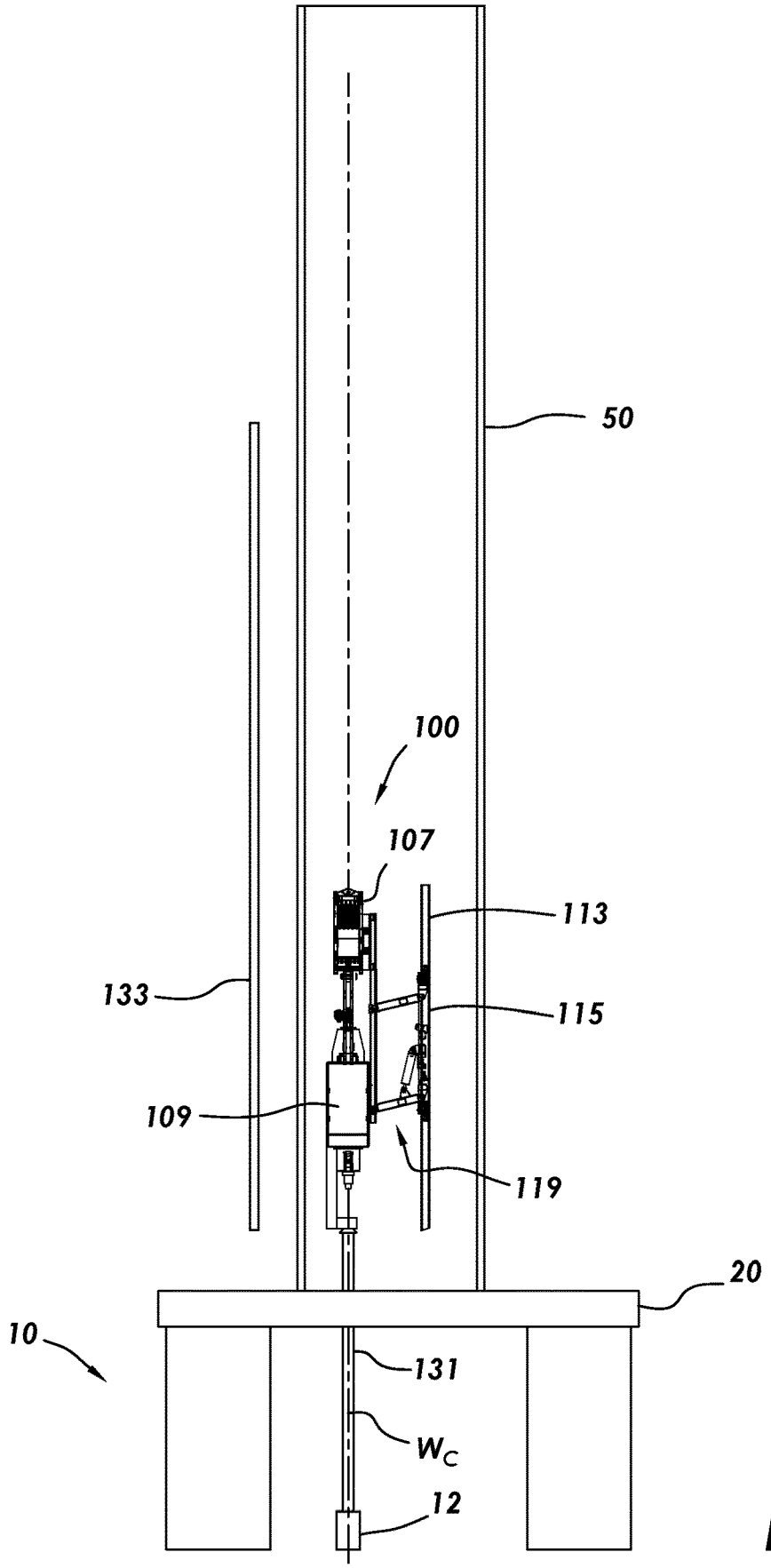
FIGS. 3-6 depict an operation sequence of a drilling rig consistent with at least one embodiment of the present disclosure.

FIGS. 3-6 depict a sequence of operations consistent with at least one embodiment of the present disclosure of drilling rig 10 that includes top drive system 100. FIG. 3 depicts drilling rig 10 in a position consistent with a tripping-in or drilling operation at which time a pipe stand was added to the drill string, depicted as upper tubular 131, and lowered into wellbore 12. Although described with respect to pipe stands and drill strings, casing and casing strings may be used as described herein. Top drive 109 may be disengaged from upper tubular 131 as understood in the art. In a typical operation, top drive 109 must be raised above the height of the next tubular to be added, depicted as next tubular 133, before next tubular 133 may be positioned in line with upper tubular 131 at wellbore centerline $w_c$ as top drive 109 would typically remain in line with wellbore centerline $w_c$ at all times.

Figure 4:
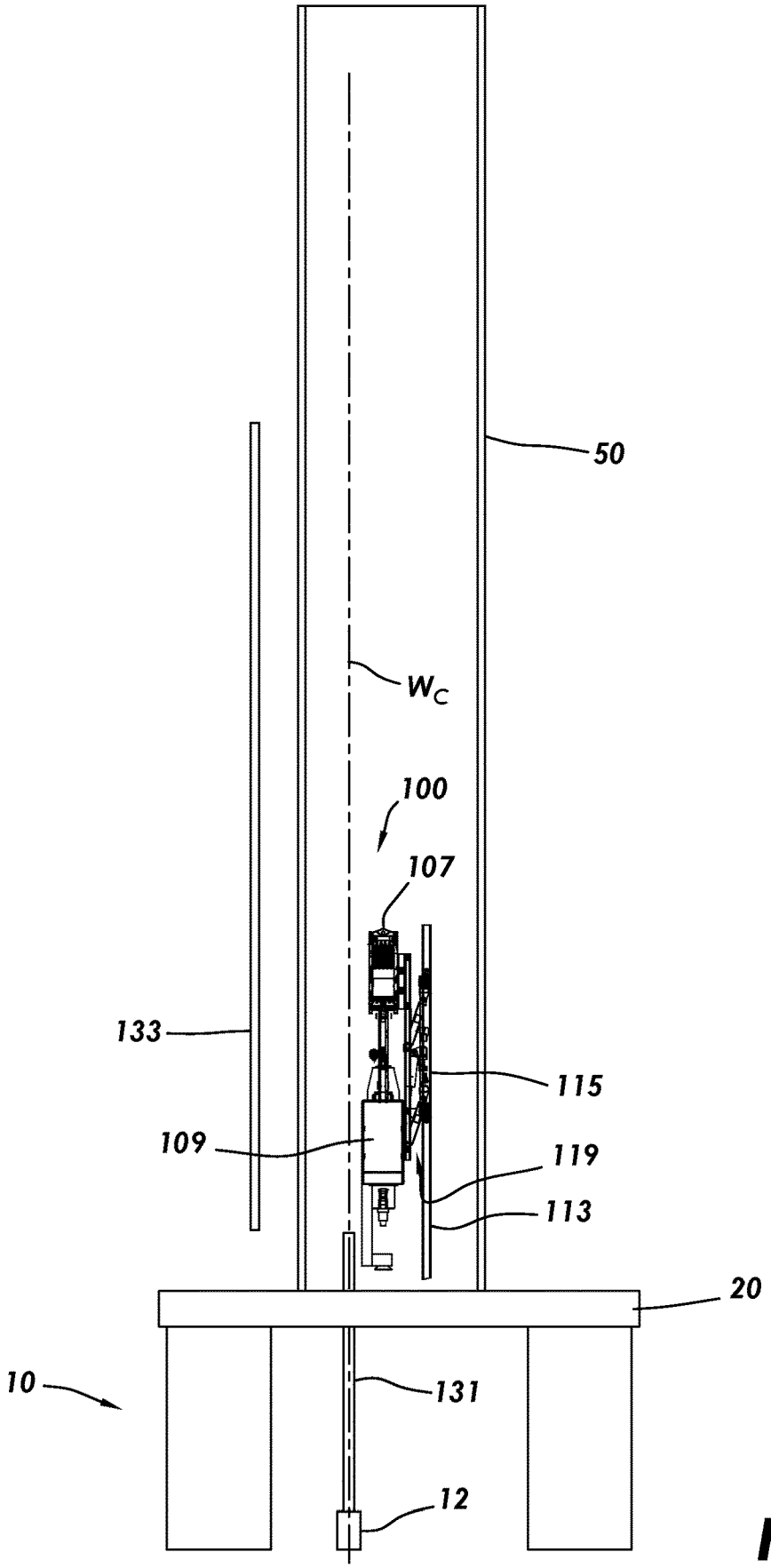
Figure 5:
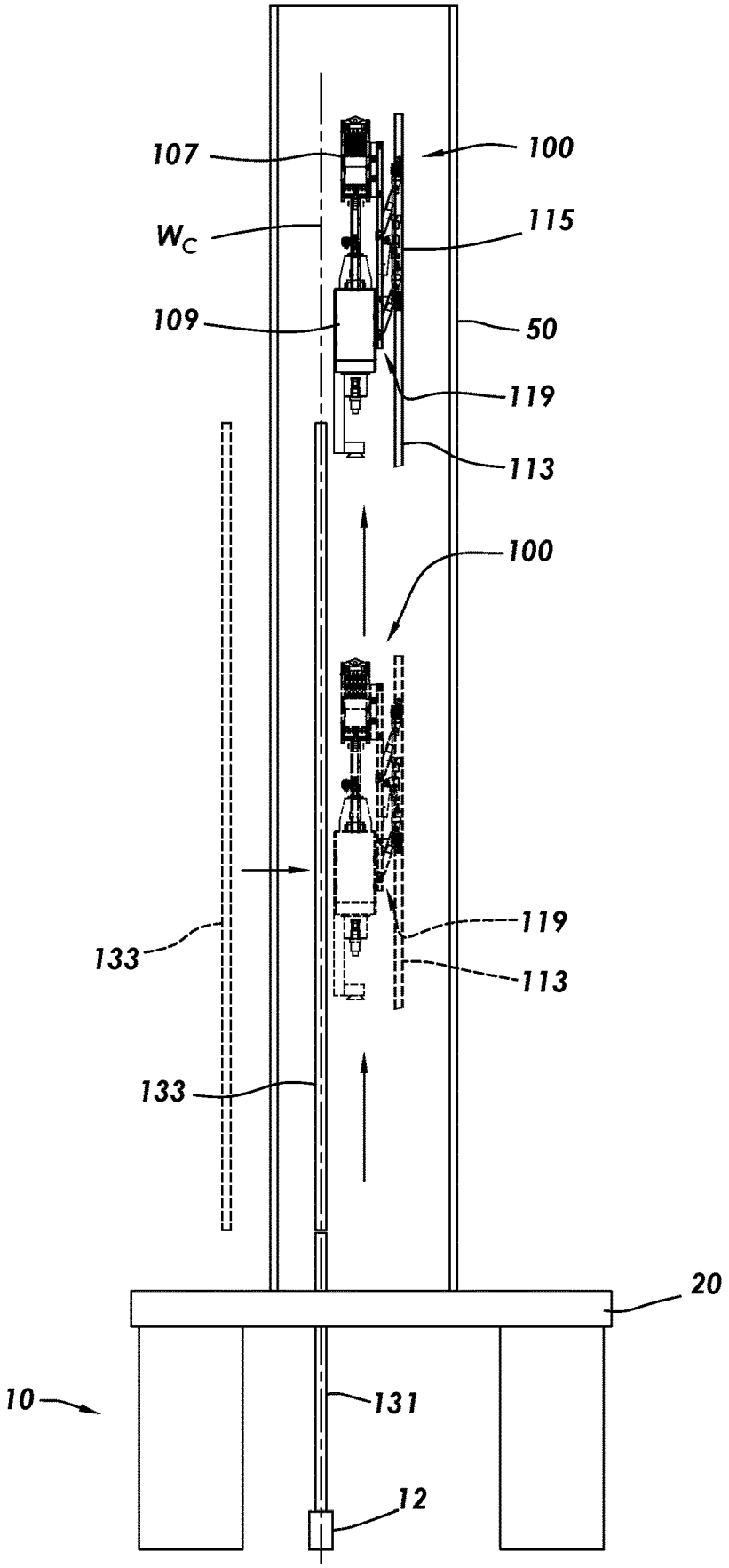

Instead, top drive system 100 may be moved to the retracted position using top drive extension mechanism 119 while top drive system 100 remains in the lower position as shown in FIG. 4. As top drive 109 and the other components of top drive system 100 are moved out of alignment with wellbore centerline $w_c$, the area above upper tubular 131 may be accessible to operators of drilling rig 10 such that next tubular 133 may be moved into position from racking board 70 manually or using pipe handling apparatus 80 while top drive system 100 is being raised as shown in FIG. 5. Next tubular 133 may therefore be moved into position and made up to upper tubular 131 during the time that top drive 109 is in the process of being raised, a time period that is typically unusable for the make-up operation.

Figure 6:
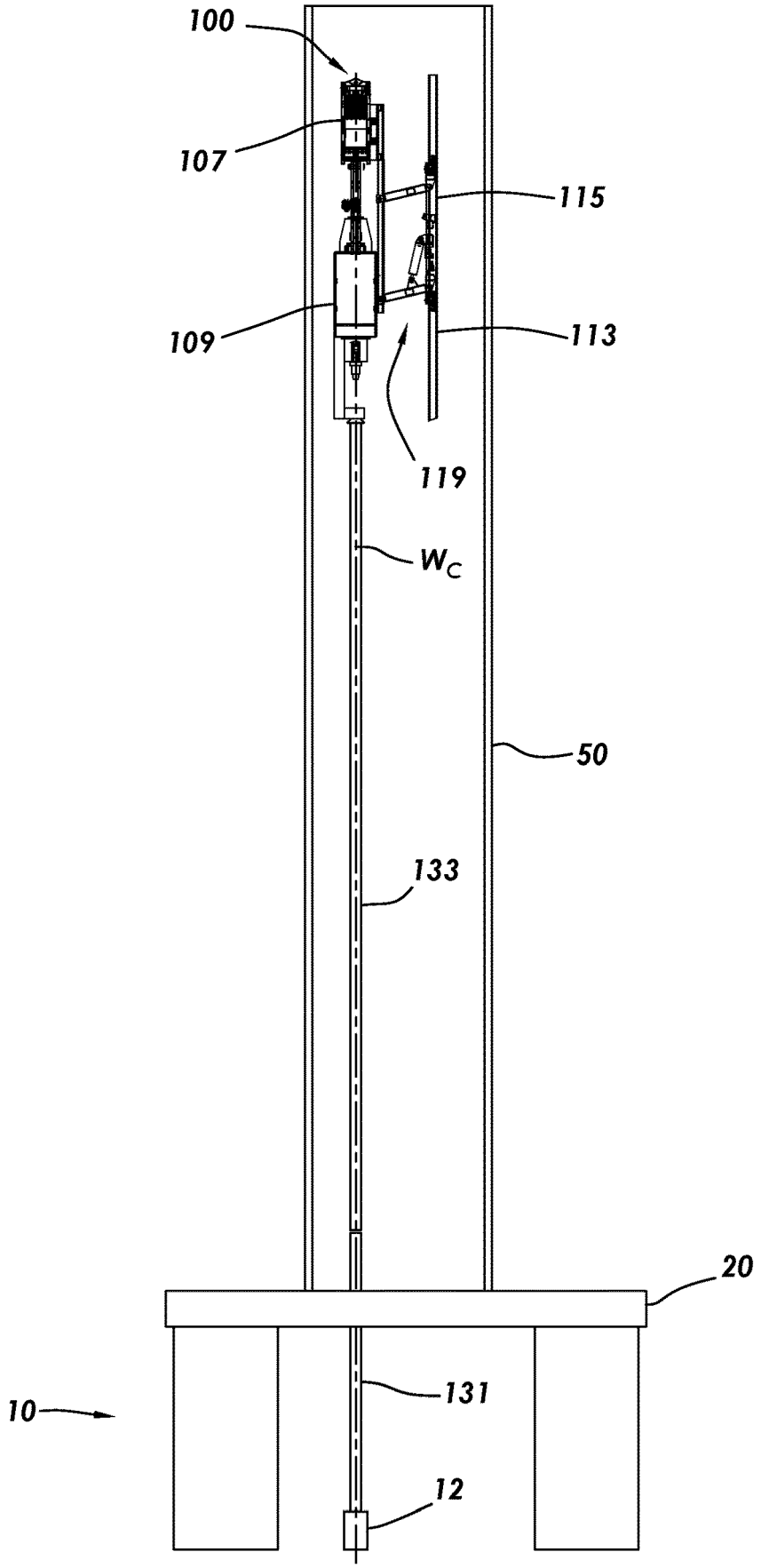

Once top drive system 100 is fully raised, top drive 109 may be extended into alignment with wellbore centerline $w_c$ using top drive extension mechanism 119 and can be recoupled to the drill string at next tubular 133 as shown in FIG. 6. Drilling or tripping operations may then resume, with the above sequence repeated at each time a new tubular is added to the drill string, thereby saving rig time at each connection.

Although presented herein as a tripping-in or drilling operation, one of ordinary skill in the art with the benefit of this disclosure will understand the applicability of the example operation discussed above to other operations of drilling rig 10. For example, during a tripping-out operation, top drive 109 may be retracted at the upper position once disengaged from the drill string and lowered while the uppermost stand is broken-out from the rest of drill string and removed from above wellbore centerline $w_c$.

In other embodiments, as depicted in FIGS. 7-10, top drive system 100' may be directly coupled to guide rails 113' without inclusion of a top drive extension mechanism. Rather than being fixed to mast 50', in some such embodiments, guide rails 113' may be coupled to mast 50 such that guide rails 113' may be moved substantially horizontally relative to mast 50 or pivotable relative to mast 50'. In some embodiments, mast 50' may include one or more guide rail extension mechanisms 114' configured to allow the movement of guide rails 113' relative to mast 50'. As top drive system 100' is coupled to guide rails 113', movement of guide rails 113' may be used to move top drive system 100' between the extended position in alignment with wellbore centerline $w_c$ and the retracted position out of alignment with wellbore centerline $w_c$.

Figure 7:
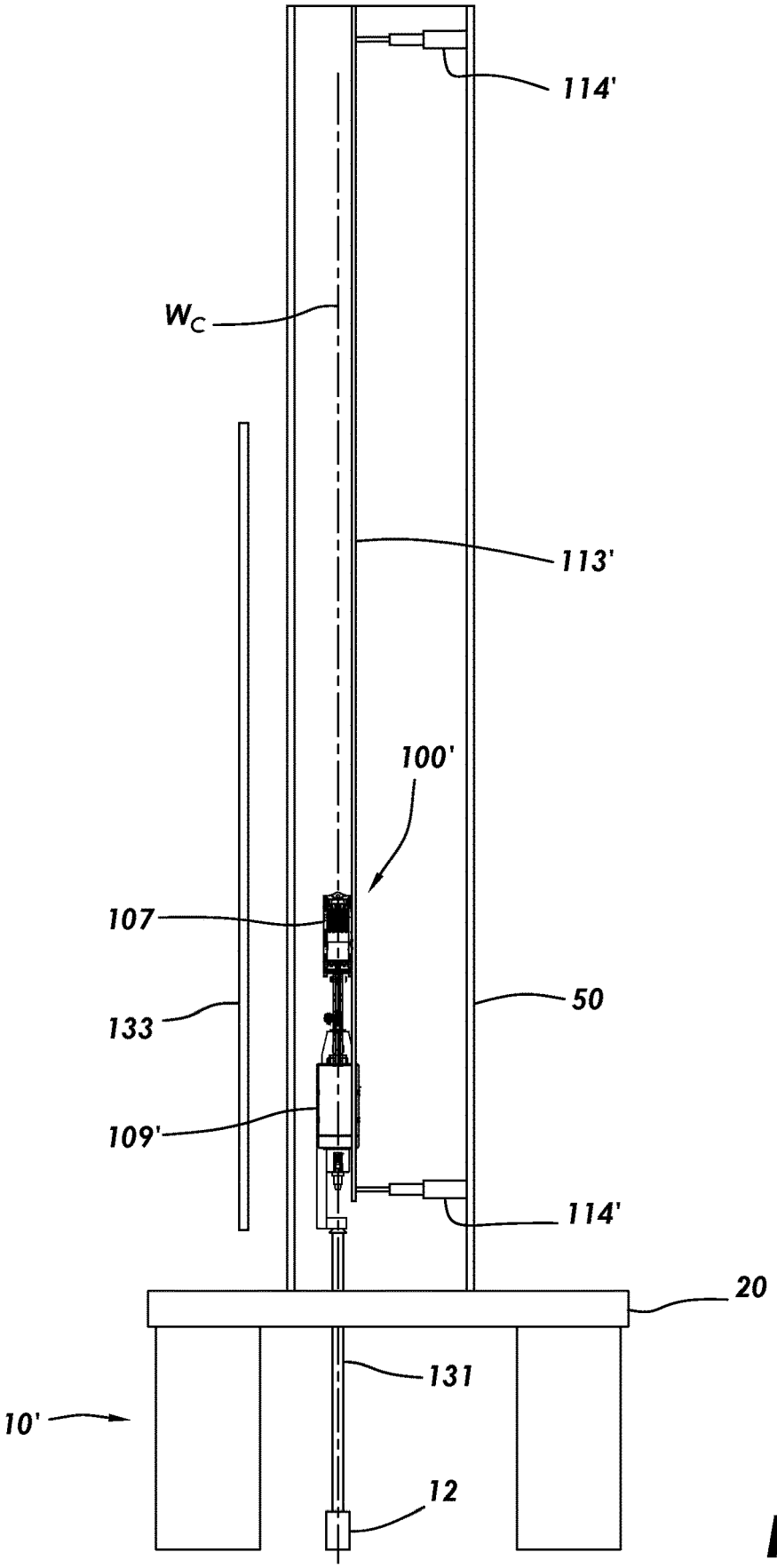
FIGS. 7-10 depict an operation sequence of a drilling rig consistent with at least one embodiment of the present disclosure.

FIGS. 7-10 depict a sequence of operations consistent with at least one embodiment of the present disclosure of drilling rig 10' that includes top drive system 100'. FIG. 7 depicts drilling rig 10' in a position consistent with a tripping-in or drilling operation at which time a pipe stand was added to the drill string, depicted as upper tubular 131, and lowered into wellbore 12. Top drive 109' may be disengaged from upper tubular 131 as understood in the art.

Figure 8:
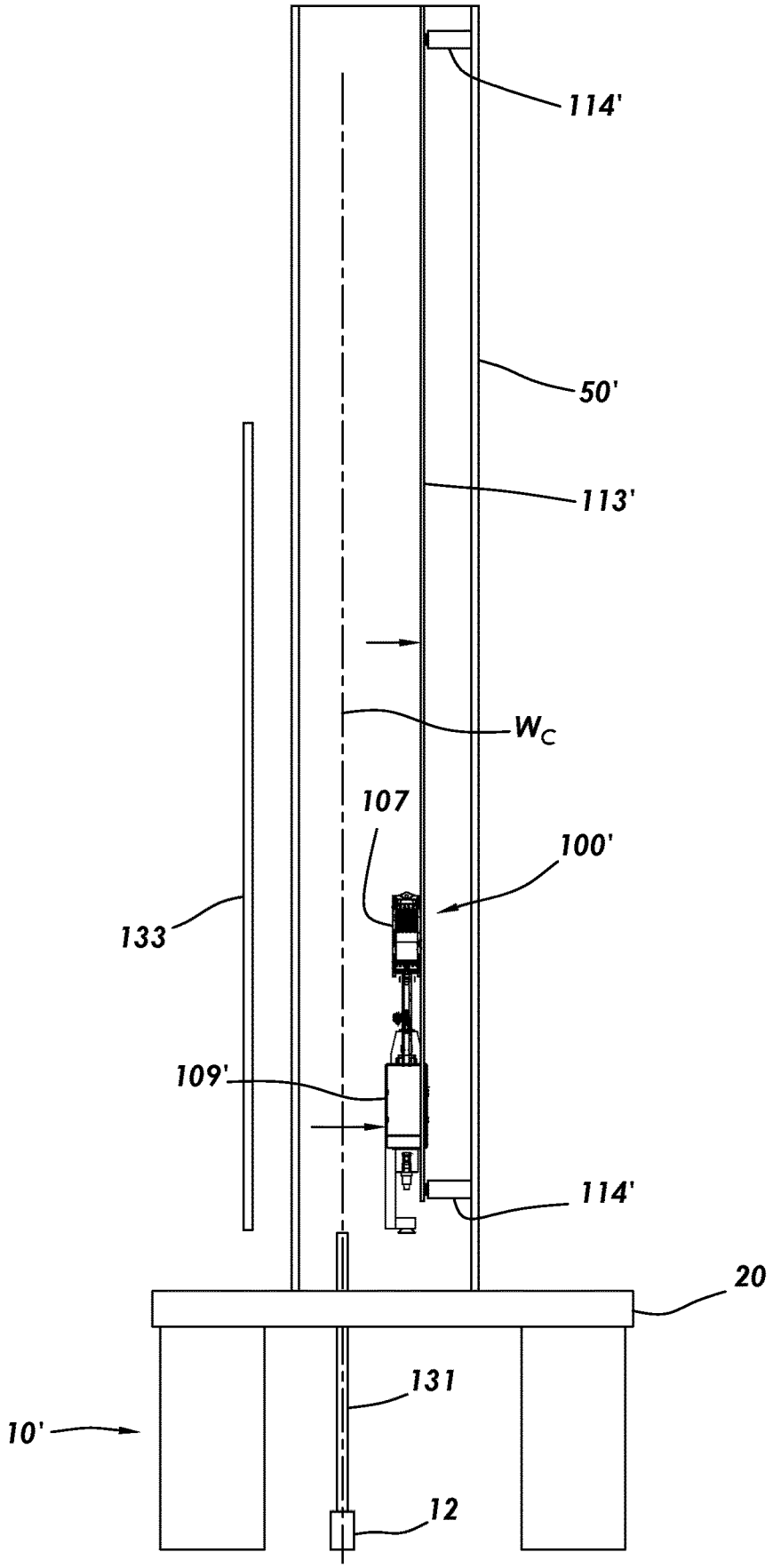
Figure 9:
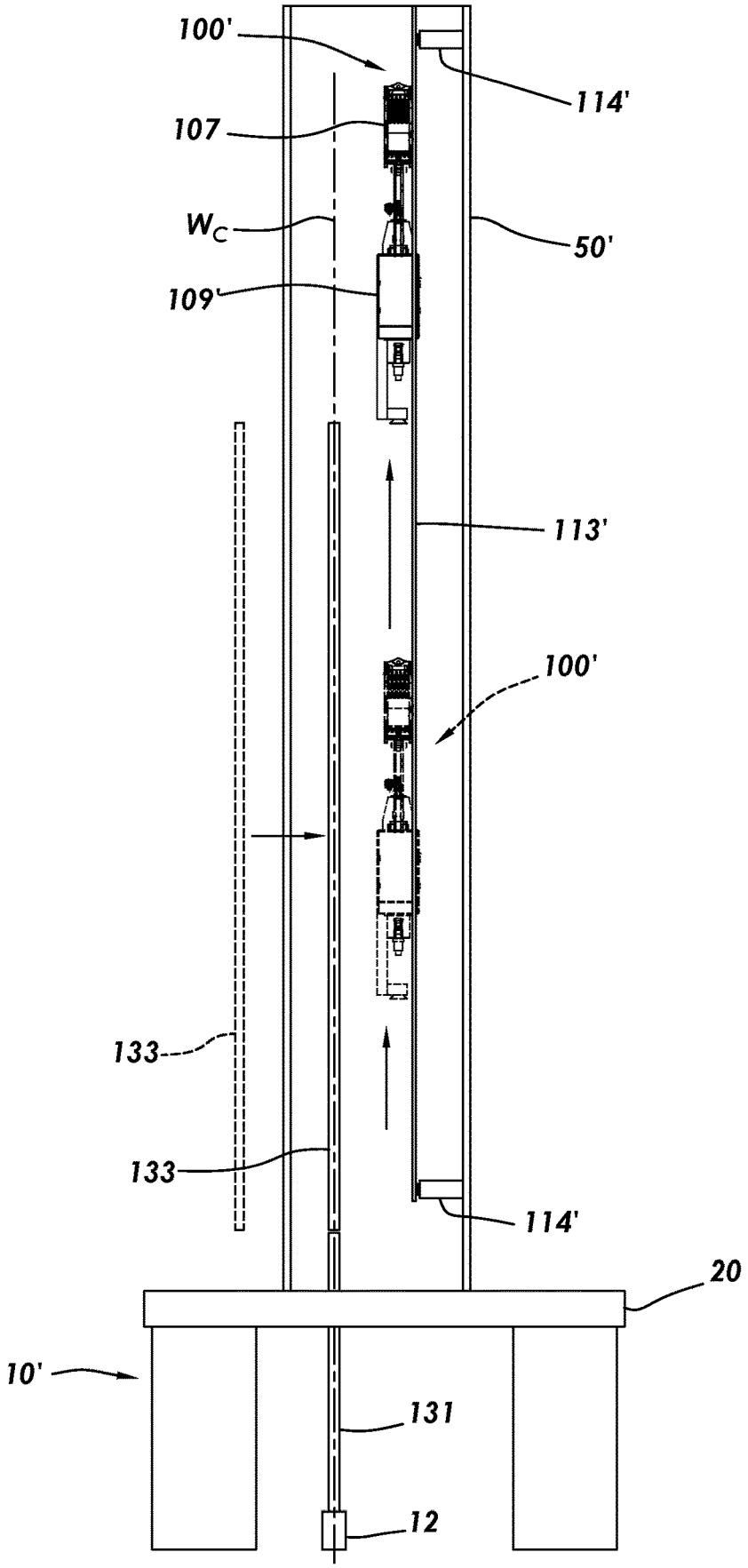

Instead, top drive 109' may be moved to the retracted position by moving guide rails 113' using guide rail extension mechanisms 114' while top drive system 100' remains in the lower position as shown in FIG. 8. As top drive 109' and the other components of top drive system 100' are moved out of alignment with wellbore centerline $w_c$, the area above upper tubular 131 may be accessible to operators of drilling rig 10' such that next tubular 133 may be moved into position from racking board 70 manually or using pipe handling apparatus 80 while top drive system 100' is being raised as shown in FIG. 9. Next tubular 133 may therefore be moved into position and made up to upper tubular 131 during the time that top drive 109' is in the process of being raised, a time period that is typically unusable for the make-up operation.

Figure 10:
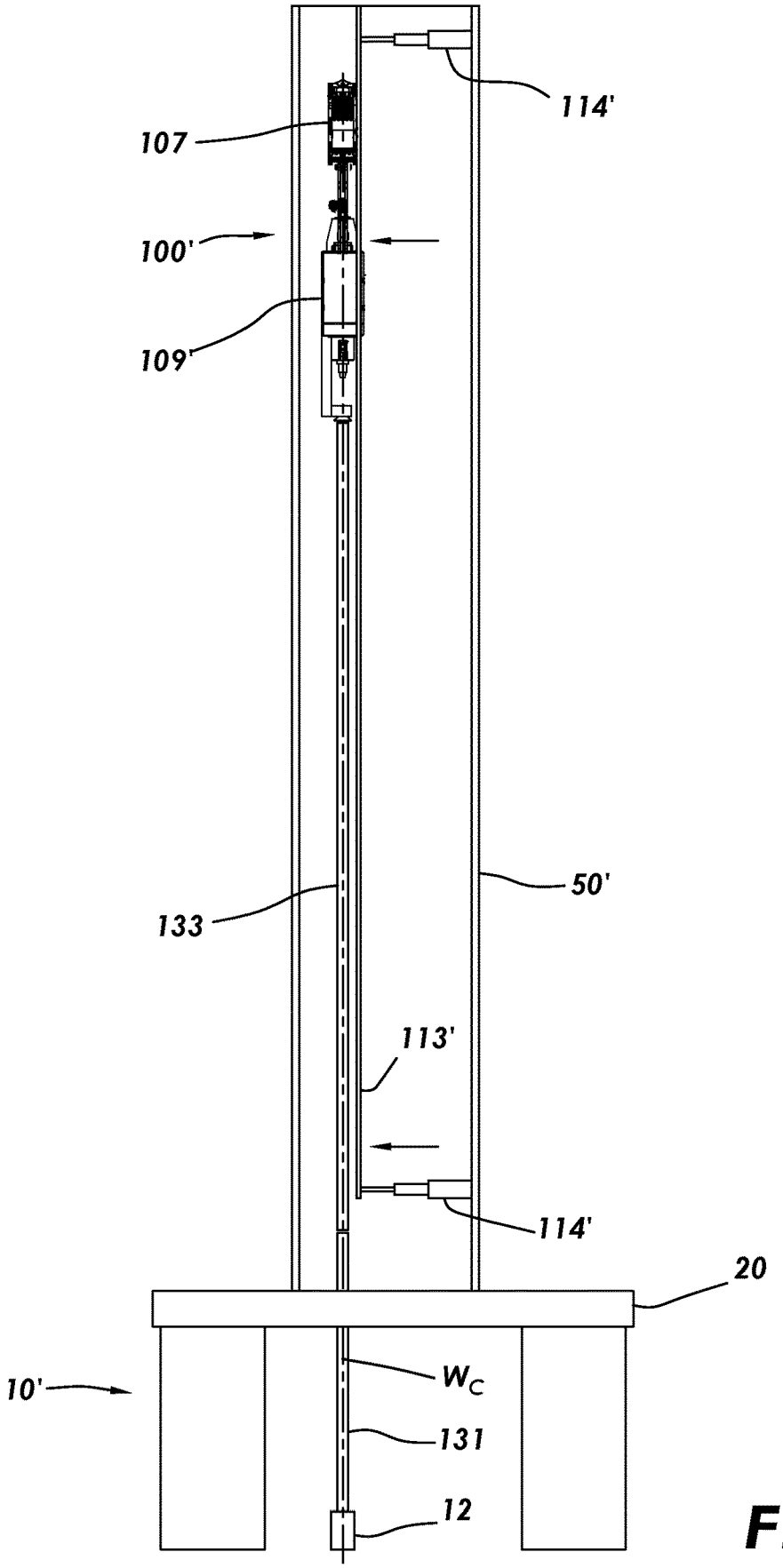

Once top drive system 100' is fully raised and next tubular 133 is made-up to upper tubular 131, top drive 109' may be extended into alignment with wellbore centerline $w_c$ by moving guide rails 113' using guide rail extension mechanisms 114' and may be recoupled to the drill string at next tubular 133 as shown in FIG. 10. Drilling or tripping operations may then resume, with the above sequence repeated at each time a new tubular is added to the drill string, thereby saving rig time at each connection.

Although presented herein as a tripping-in or drilling operation, one of ordinary skill in the art with the benefit of this disclosure will understand the applicability of the example operation discussed above to other operations of drilling rig 10'. For example, during a tripping-out operation, top drive 109' may be retracted at the upper position once disengaged from the drill string and lowered while the uppermost stand is broken-out from the rest of drill string and removed from above wellbore centerline $w_c$.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

positioning a side saddle drilling rig above a wellbore, the wellbore defining a wellbore centerline, the side saddle drilling rig including:

a mast, the mast aligned with the wellbore centerline;

a first substructure and a second substructure, wherein the first substructure and the second substructure support a drill rig floor and wherein the first substructure and the second substructure are parallel and spaced apart;

a V-door, the V-door defining the V-door side of the drill rig floor, the V-door side of the drilling rig floor parallel to a long axis of the first substructure or a long axis of the second substructure;

a top drive system, the top drive system including a top drive, the top drive movable vertically relative to the mast, the top drive movable horizontally between a position aligned with the wellbore centerline and a position out of alignment with the wellbore centerline; and a plurality of guide rails, the guide rails positioned parallel to the mast and coupled to the mast, wherein the guide rails are horizontally movably or pivotably coupled to the mast;

coupling a drill string to the top drive;

lowering the drill string into the wellbore by lowering the top drive system;

decoupling the drill string from the top drive;

retracting the top drive from the wellbore centerline, wherein the retracting operation comprises moving the guide rails into a position at which the top drive is retracted from the wellbore centerline;

positioning a new tubular member into the space above the drill string aligned with the wellbore centerline;

coupling the new tubular member to the drill string;

moving the top drive to a raised position while the new tubular member is aligned with the wellbore centerline;

extending the top drive into alignment with the wellbore centerline, and wherein the extending operation comprises moving the guide rails into a position at which the top drive is aligned with the wellbore centerline; and coupling the new tubular member to the top drive.

2. The method of claim 1, wherein the top drive system includes a trolley, the trolley mechanically coupled to the guide rails.

3. The method of claim 2, wherein the trolley is mechanically coupled to the top drive by a top drive extension mechanism, wherein the top drive extension mechanism includes one or more linkages coupled between the top drive and the trolley and an actuator positioned to cause the linkages to pivot relative to the trolley and top drive such that the distance between the trolley and top drive may be increased and, wherein the retracting operation comprises retracting the top drive from the wellbore centerline using the top drive extension mechanism, and wherein the extending operation comprises extending the top drive into alignment with the wellbore centerline using the top drive extension mechanism.

4. The method of claim 2, wherein the top drive system further comprises a traveling block, and wherein the trolley is mechanically coupled to the traveling block.

5. A method comprising:

positioning a side saddle drilling rig above a wellbore, the wellbore defining a wellbore centerline, the side saddle drilling rig including:

a mast, the mast aligned with the wellbore centerline;

a first substructure and a second substructure, wherein the first substructure and the second substructure support a drill rig floor and wherein the first substructure and the second substructure are parallel and spaced apart;

a V-door, the V-door defining the V-door side of the drill rig floor, the V-door side of the drilling rig floor parallel to either a long axis to the first substructure or a long axis to the second substructure;

a top drive system, the top drive system including a top drive, the top drive movable vertically relative to the mast, the top drive movable horizontally between a position aligned with the wellbore centerline and a position out of alignment with the wellbore centerline; and a plurality of guide rails, the guide rails positioned parallel to the mast and coupled to the mast, wherein the guide rails are horizontally movably or pivotably coupled to the mast;

coupling a drill string to the top drive;

raising the drill string by raising the top drive system;

decoupling the drill string from the top drive;

retracting the top drive from the wellbore centerline, wherein the retracting operation comprises moving the guide rails into a position at which the top drive is retracted from the wellbore centerline;

decoupling a tubular member from the upper end of the drill string;

removing the tubular member from the space above the drill string aligned with the wellbore centerline;

moving the top drive to a lowered position while the tubular member is decoupled from the drill string and is aligned with the wellbore centerline;

extending the top drive into alignment with the wellbore centerline, wherein the extending operation comprises moving the guide rails into a position at which the top drive is aligned with the wellbore centerline; and coupling the drill string to the top drive.

6. The method of claim 5, wherein the top drive system includes a trolley, the trolley mechanically coupled to the guide rails.

7. The method of claim 6, wherein the trolley is mechanically coupled to the top drive by a top drive extension mechanism, wherein the top drive extension mechanism includes one or more linkages coupled between the top drive and the trolley and an actuator positioned to cause the linkages to pivot relative to the trolley and top drive such that the distance between the trolley and top drive may be increased and, wherein the retracting operation comprises retracting the top drive from the wellbore centerline using the top drive extension mechanism, and wherein the extending operation comprises extending the top drive into alignment with the wellbore centerline using the top drive extension mechanism.

8. The method of claim 6, wherein the top drive system further comprises a traveling block, and wherein the trolley is mechanically coupled to the traveling block.

9. A side saddle drilling rig comprising:

a mast, the mast aligned with a wellbore, the wellbore defining a wellbore centerline;

a first substructure and a second substructure, wherein the first substructure and the second substructure support a drill rig floor and wherein the first substructure and the second substructure are parallel and spaced apart;

a V-door, the V-door defining the V-door side of the drill rig floor, the V-door side of the drilling rig floor parallel to a long axis of the first substructure or a long axis of the second substructure;

a top drive system, the top drive system including a top drive, the top drive movable vertically relative to the mast, the top drive movable horizontally between a position aligned with the wellbore centerline and a position out of alignment with the wellbore centerline, wherein the top drive system includes a trolley, the trolley mechanically coupled to the guide rails mechanically coupled to the mast, and wherein the trolley is mechanically coupled to the top drive by a top drive extension mechanism and wherein the top drive extension mechanism includes one or more linkages coupled between the top drive and the trolley and an actuator positioned to cause the linkages to pivot relative to the trolley and top drive such that the distance between the trolley and top drive may be increased; and a plurality of guide rails, the guide rails positioned parallel to the mast and coupled to the mast, wherein the guide rails are horizontally movably or pivotably coupled to the mast and wherein the guide rails are configured to move in a substantially horizontal direction or pivot.

10. The drilling rig of claim 9, wherein the top drive system further comprises a traveling block, and wherein the trolley is mechanically coupled to the traveling block.

* * * * *